United States Patent [19]

Vicino

[11] 4,369,591

[45] Jan. 25, 1983

[54] INFLATABLE DISPLAY STRUCTURE

[76] Inventor: Robert K. Vicino, 8847 Complex Dr., San Diego, Calif. 92123

[21] Appl. No.: 270,082

[22] Filed: Jun. 3, 1981

[51] Int. Cl.[3] ..... G09F 15/00

[52] U.S. Cl. ..... 40/610; 40/611; 52/2; 40/214

[58] Field of Search ..... 46/87, 88; 40/610, 611, 40/214, 584, 624; 52/2

[56] References Cited

U.S. PATENT DOCUMENTS

| | | | |
|---|---|---|---|
| 1,924,236 | 8/1933 | Friedberg | 40/214 |
| 2,762,327 | 9/1956 | Weig | 52/2 |
| 2,939,467 | 6/1960 | Meyer et al. | 52/2 |
| 3,059,657 | 10/1962 | Turner | 52/2 |

FOREIGN PATENT DOCUMENTS

| | | | |
|---|---|---|---|
| 1522521 | 3/1968 | France | 40/214 |
| 1487303 | 9/1977 | United Kingdom | 40/214 |

*Primary Examiner*—Gene Mancene
*Assistant Examiner*—Wenceslao J. Contreras
*Attorney, Agent, or Firm*—Charmasson, Branscomb & Holz

[57] ABSTRACT

An inflatable billboard or other display structure utilizing an elongated inflated bag for its principal structural support, bag defining one or more display surfaces to which billboard-sized display facings are releasably mounted with snaps or the equivalent, the entire structure being anchored by water-filled bags in one embodiment so that the entire structure is easily drained, deflated, and transported to another site. An optional, continuously operable blower motor is provided in one embodiment to insure the continuous inflated state of the billboard despite the presence of leaks along the seams and the like.

12 Claims, 2 Drawing Figures

INFLATABLE DISPLAY STRUCTURE

BACKGROUND OF THE INVENTION

The invention is in the field of outdoor advertising and particularly pertains to billboards.

Current billboard installations are expensive, running into tens of thousands of dollars in some instances. The advertising copy on a billboard must be changed every several weeks to maximize advertising efficiency, as the public passing the particular billboard becomes saturated within that time.

This necessitates frequent billboard changes. Two techniques of changing billboards involve pasting on paper segments of the billboard and, more currently, pre-painted plywood sections are being used because they are more durable than paper and do not tear.

In addition to the initial cost of a billboard installation and the cost and difficulty of the frequent periodic rotation of advertisements that must take place, an increasing problem is being encountered pertaining to laws and local ordinances prohibiting, limiting, or requiring licensing of billboards and other forms of advertising. Often these regulations relate to the degree of permanency of advertising matter, being more stringent the more permanent the advertising installation becomes. Regulations vary from outright bans of billboards along interstate highways, to restrictions on sign styles and size above a business establishment.

However, it has been found unconstitutional to ban advertising on the sides of motor vehicles, and generally speaking portable billboards, at least arguably, fall within the same exception to billboard and sign restrictions. This had led to the creation of sign companies which mount billboards and signs on trailers which are parked in front of business establishments to advertise products and promotions.

SUMMARY OF THE INVENTION

The instant invention is designed to the end of ameliorating all of the above stated difficulties with billboards, and to a certain extent signs. It comprises an inflatable billboard which is self-supporting, being sustained structurally by the inflation pressure. A releasable anchoring is effected through tethers which are staked to the ground, water bladders which act as ballast which are incorporated in the billboard structure, or a combination of the above, depending in part on the surface to which the billboard is to be mounted, and the level of winds in the area.

Because the structure is portable, it falls outside ordinances based on permanency of installation, and can accomodate ordinances defining a time limit for signs in a particular location. Simplicity of erection and demobilization of the unit is such that the entire thing can be moved easily and relatively quickly from site to site, and the billboard facings themselves are releasably fastened on the sides of the inflatable air bag so that they may be separately rotated with other advertising facings without moving the main inflated structure.

Inflation is accomplished either by a permanent inflation, that is a single inflation which lasts until the device is removed, or, and preferably, on-site blowers are used which continuously force air within the interior of the air bag. Use of these blowers negates the effect of leakage through seams and holes which otherwise almost certainly would occur.

DETAILED DESCRIPTION OF THE PREFERRED EMBODIMENT

Figures 1, 2:
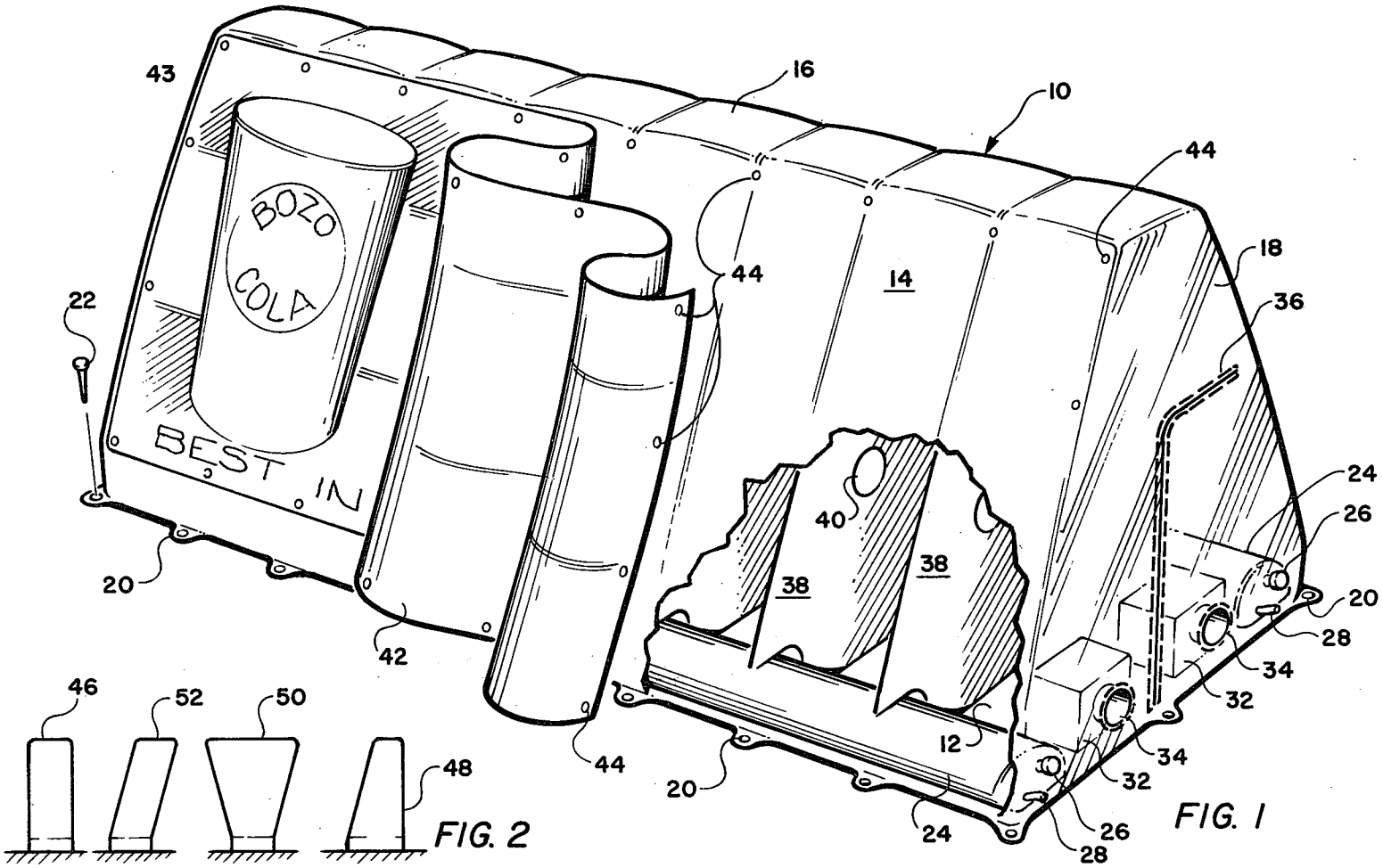
FIG. 1 is a perspective view of the billboard with portions cut away.
FIG. 2 is a diagrammatic indication of alternative billboard configurations.

As can be seen in FIG. 1, the invention comprises an inflatable air bag 10, shown in its inflated mode. The bag is made of any impermeable material, preferably one that is resistant to ultraviolet light. Materials that have met with success in outdoor implementations include vinyl or urethane coated nylon, rubber backed nylon, and rubber. The bag is made in however many panels are necessary for its size, with the panels being sewn, bonded, or both sewn and bonded together. In the illustrated embodiment, the entire bag includes a base panel 12 designed to lie on a horizontal surface such as the ground or a roof top, a pair of inwardly tapered side panels 14, top panel 16, and generally trapezoid-shaped end panels 18.

The inflated bag may be anchored by the incorporation of tethers 20, sewn to the fabric, which are anchored to the ground by stakes 22 just like a tent. Obviously this depends on a ground location, and otherwise the same tethers 20 might be used to fasten on some hook or line structure suitable to the installation.

Another method of anchoring the device incorporates a pair of longitudinally extended water bladders 24. Each of these bladders has a filling spout such as hose bib 26 and a drain line such as that indicated at 28 for the obvious purpose of filling the bladder for installation or draining same to make it portable.

As shown in FIG. 1, these bladders are mounted on top of the base panel 12 and bonded in place. Other configurations of bags, including serpentines, isolated spot bags, and any other geometrical configuration might be useful and are intended to be within the scope of the instant application.

Additionally, the bags need not necessarily be placed atop the base panel 12, but could be placed externally of the unit and fastened to it with stays, or positioned under the base panel 12. These other methods of deployment of the water bags, and any others, are considered to be within the scope of the invention.

The bag may be inflated and left in place. However, it is almost inevitable that the bag will leak some. Since the bag in the illustrated embodiment provides the entire strutural support for the signs, the billboard would not be particularly effective if it were saggy or completely deflated lying on the ground or a rooftop. Therefore, ideally a blower 2 should be connected to the air bag, either externally or internally as shown in FIG. 1, there being communication ducts 34 accessing air from externally of the bag in the latter situation.

Deflation of the bag can be accomplished by the Lshaped zipper 36, so shaped to permit access by a person inside the bag for repair during deployment, and also to permit rapid exhaust of the air both for purposes of speed, and to prevent it from flapping dangerously in the breeze when it is in a position of semi-exhaustion.

Clearly and inflated structure of the type shown in FIG. 1, if not otherwise supported, would tend to bulge at the centers of flat surfaces and approximate a sphere to the best of its ability. To maintain the shape, transverse flexible gussets 38 are sewn or bonded at spaced intervals along the length of the airbag. These gussets have voids 40 to permit the generally free flow of air from one intergusset compartment to the next for maximum ease of inflation and deflation. Additionally, horizontal gussets could be incorporated if necessary for additional support.

In the embodiment shown in FIG. 1, both sides of the air bag have plane-defining portions which are illustrated as side panels 14. These panels could be painted or otherwise impregnated directly, or covered with paper or other flexible material, which is bonded to its surface, to create an advertising message. However, due to the general incompatibility in one material of the two characteristics of impermeability and the ability to retain pigments, the most practical embodiment utilizes flexible display facings 42 having displays such as 43 which are fastened to the side panels 14 by snaps 44. The snaps could be replaced by twist locks or other suitable fasteners and generally speaking it would be necessary, or at least desirable, to line the entire periphery of the facings and underlying bag structure with strips of hook and eyelet fasteners (Velcro ®) to keep the edges from flapping and prevent wind from catching the facing and pulling it off the airbag.

The trapezoidal shape shown in FIG. 1 might be modified by providing a short base or foundation as shown in FIG. 2, which is generally for the purpose of elevating somewhat the level of the display facings 42 above the ground. They also provide more room for water bladders 24. They are defined simply by utilizing gussets which are cut to cause the side panels of the air bag to conform to this shape.

Utilization of the trapezoidal type configuration is somewhat advantageous from a windage point of view, and can be implemented when mounted on the ground or slightly above it. If the installation permits visibility from only one side, a one-sided sign can be used as diagrammatically illustrated at 48 in FIG. 2. If the billboard is elevated, the display facing should be directed downwardly somewhat. A one-sided elevated billboard is shown at 50, a two-sided elevated billboard is shown at 52, and a straight-sided billboard is shown at 46.

In the illustrated implementation, those referred to in the specification and other modifications within the scope of the claims and the instant disclosure, a billboard is provided which is portable, inexpensive, quickly erected and dismantled, and inexpensive. Undoubtedly a considerable number of variations from those shown and discussed will be implemented as the concept is explored and expanded further, the basic combination being a generally self-contained inflatable structure whose main vertical structural support is a product of the internal pressure, with the external configuration of the air bag being defined as to present at least one surface to which replaceable display facings can be snapped or otherwise releaseably mounted.

While I have described the preferred embodiment of the invention, other embodiments may be devised and different uses may be achieved without departing from the spirit and scope of the appended claims.

What is claimed is:

1. An inflatable billboard comprising:

(a) a body having an inflatable flexible skin defining an enclosure;

(b) said body defining a base panel to rest on an underlying surface (c) anchor means for securing said body in place with said base panel secured to the underlying surface;

(d) a portion of said skin defining a side panel oriented to be generally upright when said base panel is anchored;

(e) a plurality of gussets within said enclosure, said gussets being fastened to said skin to hold said side panel substantially flat when said skin is inflated; and (f) means securing a display on said side panel, whereby said inflatable billboard can be anchored on location and inflated for use as a display, or deflated into a compact form for shipment and storage.

2. Structure according to claim 1 wherein said anchor means includes a plurality of tether means spaced around said body.

3. Structure according to claim 2 and further including emptyable water bladders connected to said body to define in part said anchor means to selectably act in place of, or in concert with, said tether means.

4. Structure according to claim 1 wherein said inflatable body provides substantially the entire vertical structural support for said structure by virtue of its internal air pressure when inflated.

5. Structure according to claim 1 wherein said body has at least one continuously operable externally vented internally contained blower fan.

6. Structure according to claim 1 wherein said body is horizontally elongated, and said side panel substantially spans the length and height of said body.

7. Structure according to claim 6 wherein said side panel is provided with a series of peripheral releasible fasteners, and including a facing sheet having said display thereon, said sheet being substantially coextensive with said side panel and having means to releasibly engage said fasteners with said facing sheet being supported by said side panel.

8. Structure according to claim 1 wherein said body is elongated, and said gussets are spaced, parallel and extended laterally in said body to define a plurality of inter-gusset spaces.

9. Structure according to claim 8 wherein said gussets are each provided with a pass-through void to communicate inflation air among the inter-gusset spaces.

10. Structure according to claim 1 wherein said skin and gussets have sufficient tensile strength to hold said panel flat and upright and said body tautly inflated absent any rigid support structure for said body.

11. Structure according to claim 10 wherein said body is elongated, said gussets comprise a series of spaced parallel lateral gussets, and said body tapers laterally from a wide base to a narrowed top to define a wedge shape stable in high wind conditions.

12. Structure according to claim 11 wherein said body is substantially trapezoidal in lateral cross-section with a narrow top panel and a wide base panel for bilateral windage reduction.

* * * * *